US009302507B2

(12) United States Patent
Cressman et al.

(10) Patent No.: US 9,302,507 B2
(45) **Date of Patent: *Apr. 5, 2016**

(54) METHOD OF TRANSPORTING PRINT MEDIUM IN A PRINTER

(71) Applicant: MEMJET TECHNOLOGY LIMITED, Dublin (IE)

(72) Inventors: William Stone Cressman, San Diego, CA (US); Kenneth Andrew Regas, San Diego, CA (US); Jonathan Day Lucas, San Diego, CA (US); David Collins Burney, San Diego, CA (US); Patrick Kirk, San Diego, CA (US); Steve Inderieden, San Diego, CA (US); Neil Doherty, San Diego, CA (US); Lai Say Poh, Singapore (SG); Joo Beng Koh, Singapore (SG); Gilbert Magsakay, Singapore (SG)

(73) Assignee: Memjet Technology Limited (IE)

( * ) Notice: Subject to any disclaimer, the term of this patent is extended or adjusted under 35 U.S.C. 154(b) by 0 days.

This patent is subject to a terminal disclaimer.

(21) Appl. No.: 14/515,221

(22) Filed: Oct. 15, 2014

(65) Prior Publication Data

US 2015/0029281 A1 Jan. 29, 2015

Related U.S. Application Data

(63) Continuation of application No. 13/922,926, filed on Jun. 20, 2013, now Pat. No. 8,926,086.

(60) Provisional application No. 61/769,026, filed on Feb. 25, 2013.

(51) Int. Cl.
*B41J 11/00* (2006.01)

(52) U.S. Cl.
CPC ..... *B41J 11/0085* (2013.01); *B41J 11/001* (2013.01); *B41J 11/007* (2013.01)

(58) Field of Classification Search
CPC ..... B41J 29/02; B41J 11/007; B41J 2/16585; B41J 11/001; B41J 15/04; B41J 11/0085
USPC ..... 347/104
See application file for complete search history.

(56) References Cited

U.S. PATENT DOCUMENTS

| | | | | |
|---|---|---|---|---|
| 3,477,558 | A | 11/1969 | Fleischauer | |
| 3,698,706 | A | 10/1972 | Mihojevich et al. | |
| 3,844,552 | A | 10/1974 | Bleau et al. | |
| 4,634,112 | A * | 1/1987 | Silverberg | G03B 27/625 271/224 |
| 4,831,419 | A | 5/1989 | Iaia et al. | |
| 4,972,234 | A | 11/1990 | Tanaka et al. | |
| 5,133,543 | A * | 7/1992 | Eitel | B65H 5/24 271/197 |
| 5,392,107 | A | 2/1995 | Paxon et al. | |

(Continued)

OTHER PUBLICATIONS

Copending U.S. Appl. No. 13/922,776.*

(Continued)

*Primary Examiner* — Sarah Al Hashimi
(74) *Attorney, Agent, or Firm* — Cooley LLP

(57) ABSTRACT

A method of transporting a print medium in a printer. The includes suctioning the print medium onto an upper surface of a plurality of moving belts. The print medium experiences greater suction at an upstream side of the belts relative to a downstream side of the belts, the upstream and downstream sides being defined relative to a media feed direction.

17 Claims, 19 Drawing Sheets

(56) References Cited

U.S. PATENT DOCUMENTS

| | | | |
|---|---|---|---|
| 8,353,591 | B2 | 1/2013 | Isowa et al. |
| 2008/0289471 | A1 | 11/2008 | Todaro et al. |
| 2011/0025748 | A1 | 2/2011 | Rosati et al. |

OTHER PUBLICATIONS

Copending U.S. Appl. No. 13/922,942.*
Copending U.S. Appl. No. 13/922,926.*

* cited by examiner

METHOD OF TRANSPORTING PRINT MEDIUM IN A PRINTER

FIELD OF THE INVENTION

This invention relates to a media feed system for an inkjet printer. It has been developed primarily for reducing media buckling in wideformat printers having a fixed printhead assembly.

CO-PENDING APPLICATIONS

The following applications have been filed by the Applicant simultaneously with the present application:
MWP046US MWP048US The disclosures of these co-pending applications are incorporated herein by reference. The above applications have been identified by their filing docket number, which will be substituted with the corresponding application number, once assigned.

BACKGROUND OF THE INVENTION

Inkjet printing is well suited to the SOHO (small office, home office) printer market. Increasingly, inkjet printing is expanding into other markets, such as label and wideformat printing. Wideformat inkjet printing is attractive for printing onto a variety of media substrates, ranging from corrugated cartons and pizza boxes to display posters.

As used herein, the term "wideformat printer" refers to any printer capable of printing onto media widths greater than A4 size i.e. greater than 210 mm (8.3 inches). Usually, wideformat printers are configured for printing onto media widths of up to 36 inches (914 mm), up to 54 inches (1372 mm) or greater.

Conventional wideformat inkjet printers are characterized by their slow print speeds. In a conventional wideformat inkjet printer, the printhead traverses back and forth across the width of the media in swathes to produce a printed image. To some extent, the slow speeds and cost of printing has limited the uptake of wideformat inkjet printers.

The Assignee's Memjet® pagewide printing technology has revolutionized the inkjet printing market. Pagewidth printers employ one or more fixed printhead(s) while the print medium is fed continuously past the printhead(s). This arrangement vastly increases print speeds. Hence, wideformat printers manufactured using the Assignee's pagewide printing technology are gaining increasing fraction in the wideformat market.

US2011/0025748, the contents of which are herein incorporated by reference, describes a wideformat printer based on the Assignee's pagewidth printing technology. This printer employs a plurality of fixed printheads staggered across the page and a media feed mechanism configured for aligning print media with the printheads as the print media are fed continuously past the printheads in a single pass.

One of the challenges of high-speed wideformat printing, where print media are fed past the fixed printhead assembly at speeds of 6 inches per second or greater, is maintaining accurate registration of the print medium with the printhead assembly. In particular, the print medium should be uniformly flat and travelling at a known velocity as it passes through the print zone. Any variation in flatness or velocity potentially causes a deterioration in print quality.

The known media feed system described in US2011/0025748 comprises a drive ("grit") roller upstream of the print zone, a fixed vacuum platen in the print zone opposite the fixed printhead assembly, and a vacuum belt assembly downstream of the print zone. The vacuum belt assembly and the drive roller are coordinated via a print engine controller to maintain accurate registration of the print medium with the printhead assembly as it passes through the print zone.

One of the problems of pagewidth printing, which is particularly exacerbated in wideformat printing, is media buckling or 'tenting'. Media buckling is a term used to describe a print medium which is not uniformly flat; in other words, a print medium having ripples which result in a varying height of the media surface relative to the printhead(s). Media buckling generally causes a loss of print quality. In a worst case scenario, media buckling causes the print medium to buckle into contact with the printhead(s) and cause a severe loss of print quality.

In the printer described in US2011/0025748, a relatively small degree of skew in the downstream vacuum belt assembly can generate buckling in print media and, as a consequence, produce visible artifacts in the printed image. In practice, it is difficult to manufacture a vacuum belt assembly having perfect parallel of alignment of the vacuum belt(s) with the media feed direction. For example, microscopic eccentricities in the shafts or pulleys supporting the vacuum belts can produce small deviations in the travel direction of the belts. These deviations are transferred to the print medium engaged with the belts and tend to amplify over the duration of a print, thereby causing media buckling and loss of print quality.

It would be desirable to provide a printer having a media feed mechanism, which minimizes the extent of media buckling and provides improved print quality. It would be particularly desirable to improve the media feed mechanism described in US2011/0025748 so as to minimize media buckling.

SUMMARY OF THE INVENTION

In a first aspect, there is provided a printer comprising a vacuum belt assembly for moving print media in a media feed direction along a media path, the vacuum belt assembly comprising:

a plurality of endless belts tensioned between first and second pulleys, the first and second pulleys having respective first and second axes of rotation perpendicular to the media feed direction; and a vacuum chamber for drawing print media onto an upper surface of the belts, wherein each belt is independently laterally slidable along at least one of the first and second axes.

The printer according to the first aspect provides excellent control of media movement across the vacuum belt assembly with minimal media buckling due to the independent lateral movement of the individual belts.

Preferably, the second pulley is downstream of the first pulley with respect to the media feed direction.

Preferably, the second pulley is configured to allow a predetermined degree of lateral sliding along the second axis.

Preferably, the first pulley is configured to prevent any lateral movement of the belt along the first axis.

Preferably, the second pulley is a drive pulley operatively connected to a motor.

Preferably, the first pulley is an idler pulley.

Preferably, each belt is toothed and intermeshes with complementary grooves in at least one of the first and second pulleys.

Preferably, one first pulley and one second pulley together support a set of individual belts.

Preferably, the vacuum belt assembly comprises a plurality of first and second pulleys, each first and second pulley together supporting a respective set of individual belts.

Preferably, the second pulley comprises a plurality of circumferential ribs, each belt in the set being mounted between a respective pair of ribs, wherein a spacing between the pair of ribs is greater than a width of the belt.

Preferably, the ribs are positioned such that the belts in the set are spaced apart from each other.

Preferably, the vacuum chamber communicates with an elongate interstitial gap defined between each pair of adjacent belts.

Preferably, the belts are non-apertured belts.

Preferably, one or more vacuum antechambers are positioned in the interstitial gap defined between each adjacent pair of belts, each vacuum antechamber having a perimeter opening for suction engagement with print media, and each vacuum antechamber communicating with the vacuum chamber via a respective aperture defined in each antechamber.

Preferably, a plurality of elongate vacuum antechambers are positioned in each gap, a length dimension of each perimeter opening extending longitudinally in the media feed direction.

Preferably, a first perimeter opening of a first vacuum antechamber positioned towards an upstream side of the vacuum belt assembly is shorter than a second perimeter opening of a second vacuum antechamber positioned towards a downstream side of the vacuum belt assembly, the upstream and downstream sides being defined with respect to the media feed direction.

Preferably, the first vacuum antechamber has a first aperture defined therein and the second vacuum antechamber has a second aperture defined therein, the first and second apertures communicating with the vacuum chamber, wherein the first aperture has a larger diameter than the second aperture.

Preferably, the printer further comprises a fixed printhead assembly defining a print zone. Preferably, the fixed printhead assembly comprises a plurality of stationary printhead modules mounted in a staggered array across the media width.

Preferably, the vacuum belt assembly is positioned downstream of the fixed printhead assembly.

Preferably, the printer further comprises a fixed vacuum assembly positioned in the print zone opposite the fixed printhead assembly.

Preferably, the printer further comprises a drive roller engaged with a pinch roller, the drive roller being positioned upstream of the print zone.

Preferably, the print medium is engaged more strongly between the drive roller and pinch roller than the vacuum engaged between the print medium and the vacuum belt assembly.

Preferably, in use, the belts moves faster (e.g. about 0.5% to 2% faster) than the drive roller. Preferably, in use, the print medium slips relative to the belts by virtue of the faster movement of the belts relative to the drive roller.

In a second aspect, there is provided a printer comprising a moving vacuum belt assembly for moving print media in a media feed direction along a media path, the vacuum belt assembly comprising:

a plurality of spaced apart endless belts tensioned between first and second pulleys;

a vacuum chamber for drawing print media onto an upper surface of the belts; and a plurality of vacuum antechambers communicating with the vacuum chamber, each vacuum antechamber having a perimeter opening for suction engagement with print media, a length dimension of each perimeter opening extending longitudinally in the media feed direction, wherein a first perimeter opening of a first vacuum antechamber positioned towards an upstream side of the vacuum belt assembly is shorter than a second perimeter opening of a second vacuum antechamber positioned towards a downstream side of the vacuum belt assembly, the upstream and downstream sides being defined with respect to the media feed direction.

The printer according to the second aspect provides excellent control of suction force experienced by print media traversing across the vacuum belt assembly. The arrangement of perimeter openings of the vacuum antechambers assists, firstly, in initially grabbing print media and, secondly, in reducing media buckling by providing a lower suction force towards the downstream side of the vacuum belt assembly.

Preferably, the first vacuum antechamber has a smaller volume than the second vacuum antechamber.

Preferably, each vacuum antechamber communicates with the vacuum chamber via a respective aperture defined in each antechamber.

Preferably, the first vacuum antechamber has a first aperture defined therein and the second vacuum antechamber has a second aperture defined therein, the first and second apertures communicating with the vacuum chamber, wherein the first aperture has a larger diameter than the second aperture.

Preferably, the vacuum antechambers are positioned in an interstitial gap defined between each adjacent pair of belts, Preferably, each perimeter opening has a width which is narrower than the interstitial gap between adjacent belts.

Preferably, the vacuum chamber is a common vacuum chamber communicating with each vacuum antechamber in the vacuum belt assembly, the common vacuum chamber being connected to a vacuum source in the printer.

Preferably, the vacuum belt assembly is a modular assembly comprised of a plurality of moving belt modules and a plurality of static platen modules.

Preferably, the moving belt modules and static platen modules are interconnected in an alternating arrangement to define the vacuum belt assembly.

Preferably, the vacuum chamber extends through a body of each of the interconnected moving belt modules and static platen modules.

Preferably, each moving belt module comprises a respective set of the spaced apart endless belts, each set of the belts being tensioned between one first pulley and one second pulley.

In a third aspect, there is provided a printer comprising a vacuum belt assembly for moving print media in a media feed direction along a media path, the vacuum belt assembly comprising a plurality of moving belt modules, each moving belt module comprising:

a body having an internal chamber defining at least part of a vacuum chamber;

a first pulley positioned at a first end of the body;

a second pulley positioned at a second end of the body; and a set of spaced apart endless belts tensioned between the first and second pulleys, wherein the belts are non-apertured and the vacuum chamber communicates with an interstitial gap defined between each adjacent pair of belts in the set so as to draw print media onto an upper surface of the moving belt module.

The printer according to the third aspect provides improved stability of the suction force applied to print media as it traverses across the vacuum belt assembly. By avoiding apertured vacuum belts, the suction force is non-moving as the print media enters the vacuum belt assembly and, moreover, can be accurately controlled without relying on customized belts having apertures defined therein.

Preferably, a static platen module is positioned between each pair of moving belt modules.

Preferably, the moving belt modules and the static platen modules are interconnected in an alternating arrangement along a length of the vacuum belt assembly, the length of the vacuum belt assembly being coextensive with a width of the media path.

Preferably, each of the static and moving belt modules have complementary lateral datum features in interlocking engagement.

Preferably, each second pulley is a drive pulley and each first pulley is an idler pulley, the drive pulley being positioned downstream of the idler pulley.

Preferably, each drive pulley is mounted on a common drive shaft extending across the length of the vacuum belt assembly.

Preferably, each static platen module comprises a bearing for receiving the drive shaft.

Preferably, each set comprises three or more belts.

Preferably, each static platen module comprises a body having an internal chamber defining at least part of the vacuum chamber.

Preferably, the internal chambers of the static and moving belt modules communicate via sidewall openings to define a common vacuum chamber for the vacuum belt assembly.

Preferably, at least one of the static platen modules comprises an embedded encoder wheel for monitoring a velocity of print media moving over an upper platen surface thereof.

Preferably, each static platen module has an upper surface configured for minimizing frictional engagement with the print media.

Preferably, each static platen module has a plurality of grooves defined in the upper surface, the grooves extending longitudinally in the media feed direction for minimizing frictional engagement with the print media.

BRIEF DESCRIPTION OF THE DRAWINGS

Embodiments of the present invention will now be described by way of example only with reference to the accompanying drawings, in which.

DETAILED DESCRIPTION OF THE INVENTION

The printer of the present invention is similar in construction to the printer described in US2011/0025748. For the sake of completeness, an overview of the salient features of the print engine described in US2011/0025748 now follows.

Print Engine Overview

Figure 1:
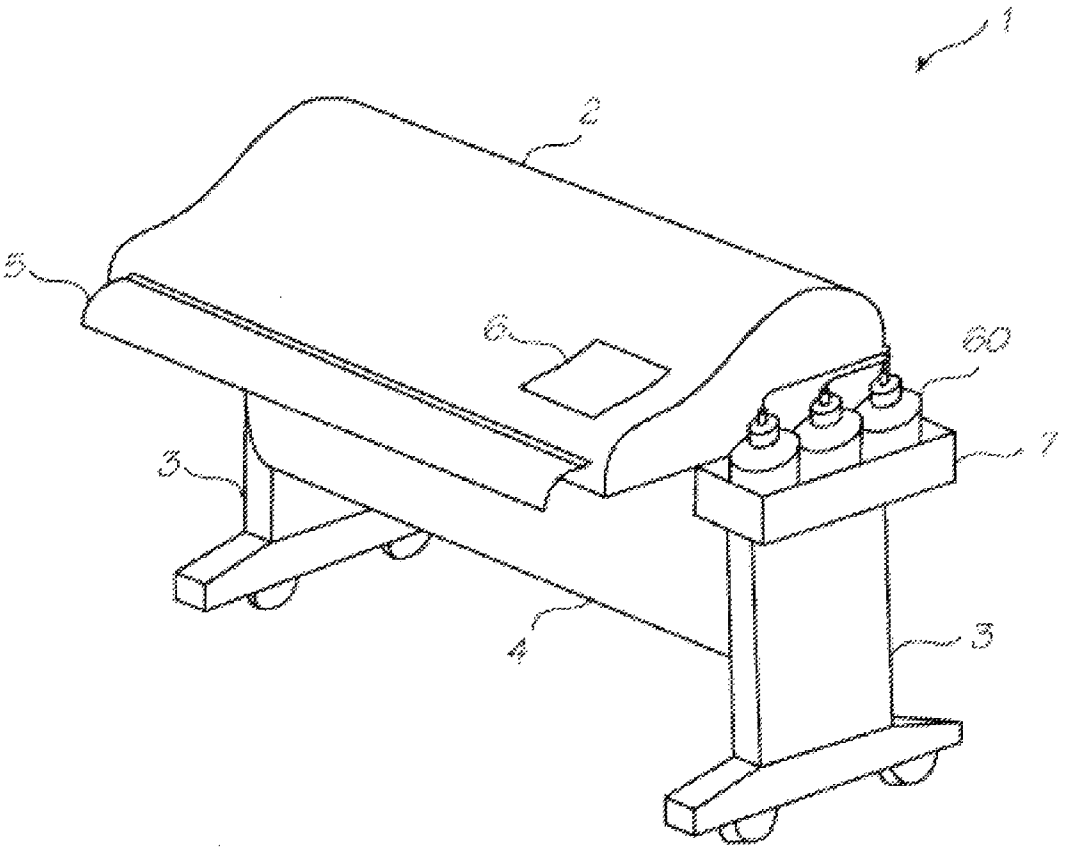
FIG. 1 is perspective of a wideformat printer.

Referring to FIG. 1, there is shown a wideformat printer 1 of the type fed by a media roll 4. The print engine, which includes the primary functional components of the printer, is housed in an elongate casing 2 supported at either end by legs 3. A roll 4 of media web (usually paper) extends between the legs 3 underneath the casing 2. A leading edge of a media web 5 is fed through a feed slot (not shown) in the rear of the casing 2, through the media path of the print engine (described below) and out an exit slot of the casing 2. At either side of the casing 2 are ink tank racks 7 supporting ink tanks 60, which store inks for supply to printhead modules in the casing 2 via an ink delivery system. User interface 6 may be in the form of a touchscreen for operator control and diagnostic feedback to the operator.

For the purposes of this specification, references to 'ink' will be taken to include any printable fluid for creating images and indicia on a media substrate, as well as any functionalized fluid such as fixatives, infrared inks, UV inks, surfactants, medicaments, 3D-printing fluids etc.

Figure 2:
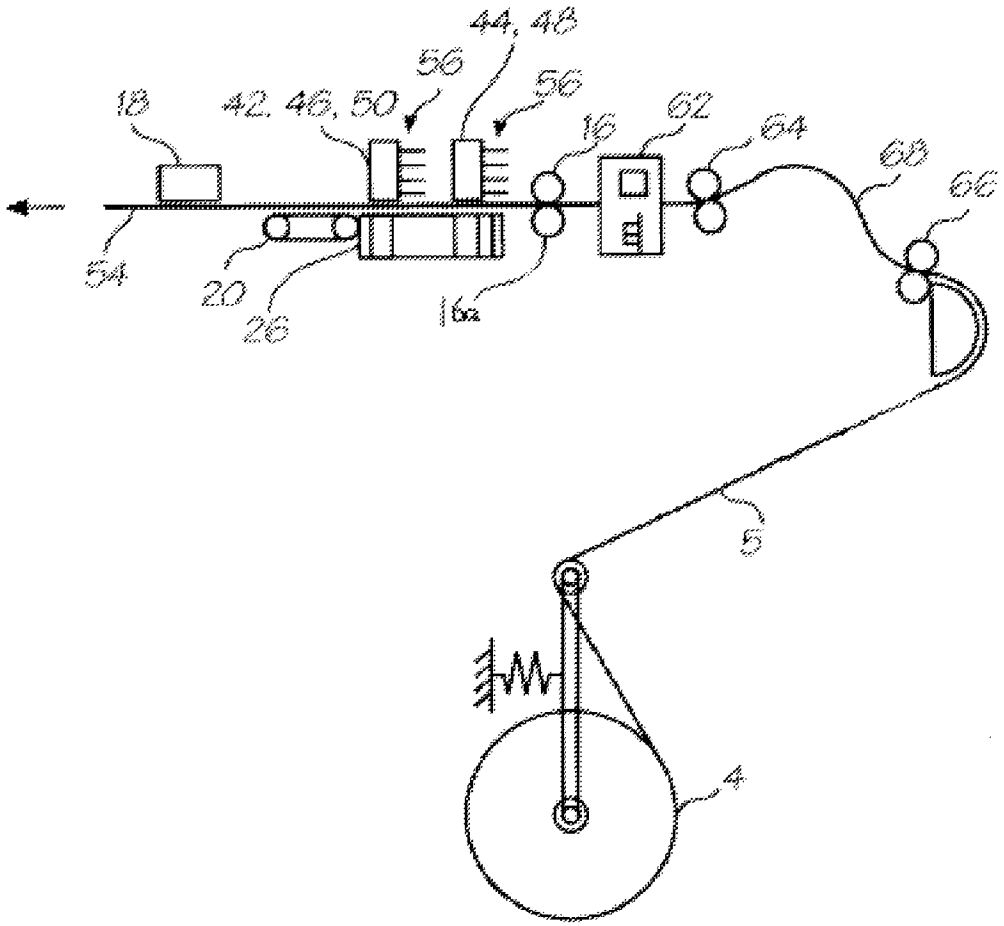
FIG. 2 is a schematic representation of the primary components of the wide format printer shown in FIG. 1.

FIG. 2 is a schematic representation of the main components of the printer 1. Media feed rollers 64 and 66 unwind the media web 5 from the roll 4. Media cutter 62 slices the continuous media web 5 to form a media sheet 54 of desired length. As the media web 5 is being cut, it needs to be stationary within the cutter 62 so as not to create a diagonal cut. However, the roll 4 must be kept rotating in order to maintain angular momentum. In light of this, the unwinder feed rollers 66 operate at a constant speed while the cutter feed rollers 64 momentarily stop during the cutting process. This creates a delay loop 68 between rollers 66 and 64 as the media bows upwards. After cutting, the media web 5 momentarily feeds through the cutter 62 faster than the speed of the unwinder feed rollers 66 to return the delay loop 68 to its initial position. (Of course, the printer 1 may alternatively be configured for web printing, either by removing the cutter 62 or not employing the cutter during feeding).

Figure 3:
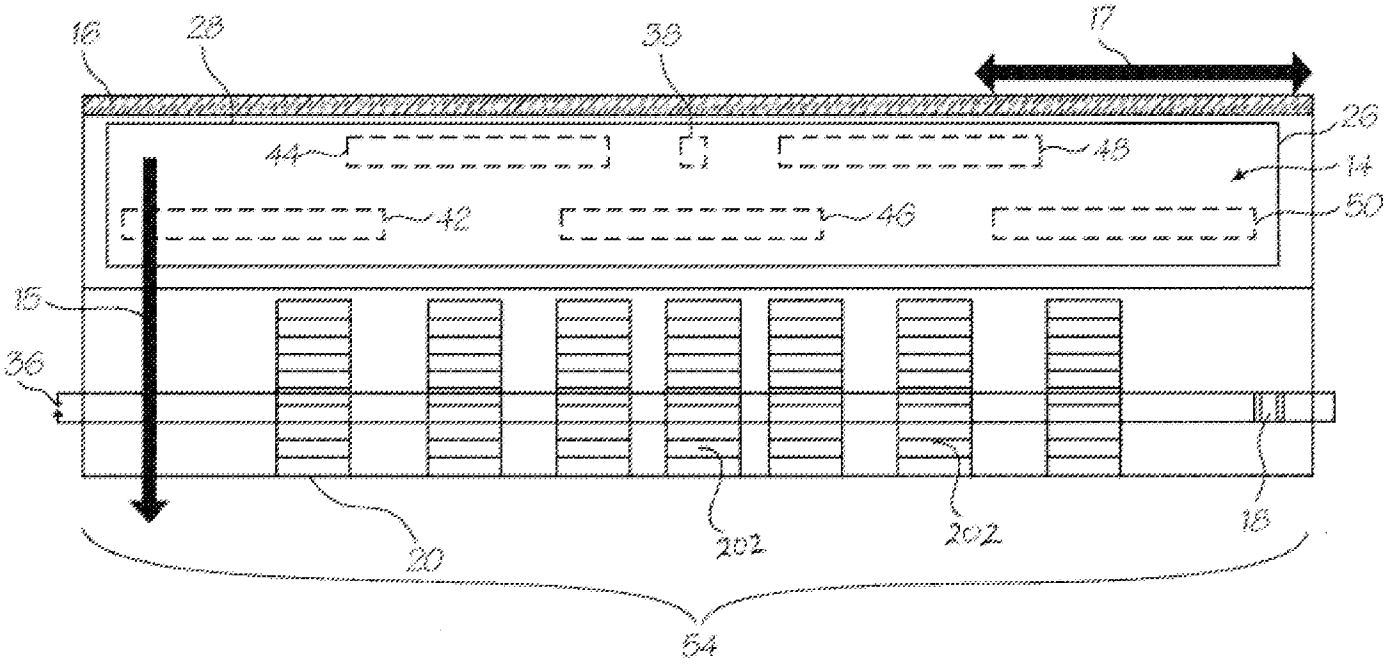
FIG. 3 is a schematic representation of a print zone of the wide format printer shown in FIG. 1, including components immediately upstream and downstream of the print zone.

After exiting the cutter 62, the separated media sheet 54 feeds through the nip of a grit-coated drive roller 16 engaged with a pinch roller 16*a*. Referring now to FIGS. 2 and 3, from the drive roller 16, the media sheet is fed over a fixed vacuum platen 26 positioned in a print zone 14 of the print engine. A vacuum system (not shown) communicating with the fixed vacuum platen 26 holds the media sheet 54 flush against an upper surface of the fixed vacuum platen to accurately retain the media sheet in the print zone 14.

A fixed printhead assembly 56 comprises five printhead modules 42, 44, 46, 48 and 50 which span the width of a media path to define the print zone 14. The printhead modules are not positioned end-to-end, but rather are staggered in an overlapping arrangement with two of the printhead modules 44, 48 positioned upstream of the printhead modules 42, 46 and 50.

A known vacuum belt assembly 20, as described in US2011/0025748, is positioned immediately downstream of the print zone 14 and fixed vacuum platen 26. The known vacuum belt assembly 20 comprises a plurality of apertured vacuum belts 202, which cooperate with the drive roller 16 to feed the media sheet 54 at a predetermined velocity through the print zone 14. The known vacuum belt assembly 20 functions as a movable platen that engages the non-printed side of the media sheet 54 and pulls it out of the print zone 14 once the trailing edge of the media sheet 54 disengages from the nip of the input drive roller 16 and pinch roller 16*a*.

FIG. 3 shows schematically in plan view a platen assembly 28 comprising the fixed vacuum platen 26, the known vacuum belt assembly 20 and the scanning head 18. From FIG. 3, it can be seen that the five printhead modules 42, 44, 46, 48 and 50 are staggered across a wideformat media path and overlap with each other along an axis 17 transverse to the media feed direction 15. Printing in the overlap between adjacent printhead modules is controlled by a supervising driver PCB, which digitally 'stitches' the print together without artifacts.

Still referring to FIG. 3, a scanning head 18 positioned downstream of the print zone 14 is configured for traversing across the media path along a scanning zone 36. When a new printhead module is installed, a test image is printed and fed past the scanning head 18. The dot pattern in the test print is optically scanned and the supervising driver PCB digitally aligns each of the printhead modules by comparing the scanned test print with a reference image. Additionally, feedback from the scanning head 18 may be used to update a dead nozzle map, compensate for misfiring nozzles, and other purposes directed toward optimizing print quality.

Still referring to FIG. 3, an encoder wheel 38 is embedded in the fixed vacuum platen 26 between the two upstream printhead modules 44 and 48. The area between the upstream printhead modules 44 and 48 is an unprinted location; therefore, the encoder wheel 38 can roll against an encoder pinch roller (not shown in FIG. 3) without smearing any printed image. This arrangement also allows the encoder wheel 38 to be as close as possible to the printheads, enabling highly accurate timing signals to be captured. The supervisor driver PCB uses the timing signal output from the encoder wheel 38 to time the drop ejections from the printhead modules 42, 44, 46, 48 and 50. Timing signals are also derived from encoders on the input drive roller 16 and the known vacuum belt assembly 20, especially for periods when the media has not reached the encoder wheel 24 or when the trailing edge of the media sheet 54 has disengaged the encoder wheel 38.

Significantly, the known vacuum belt assembly 20 has a belt speed marginally higher than the media feed speed provided by the input drive roller 16. In practice, the belt speed of the known vacuum belt assembly 20 is about 0.5 to 2% faster (typically about 1% faster) than the media feed speed provided by the drive roller 16. However, the engagement between the input drive roller 16 and the media is stronger than the engagement between the media and the vacuum belts 202. Consequently, there is a degree of slippage between the media sheet 54 and the belts 202 of the known vacuum belt assembly 20 until the trailing edge of the media disengages from the input drive roller 16.

Figure 4:
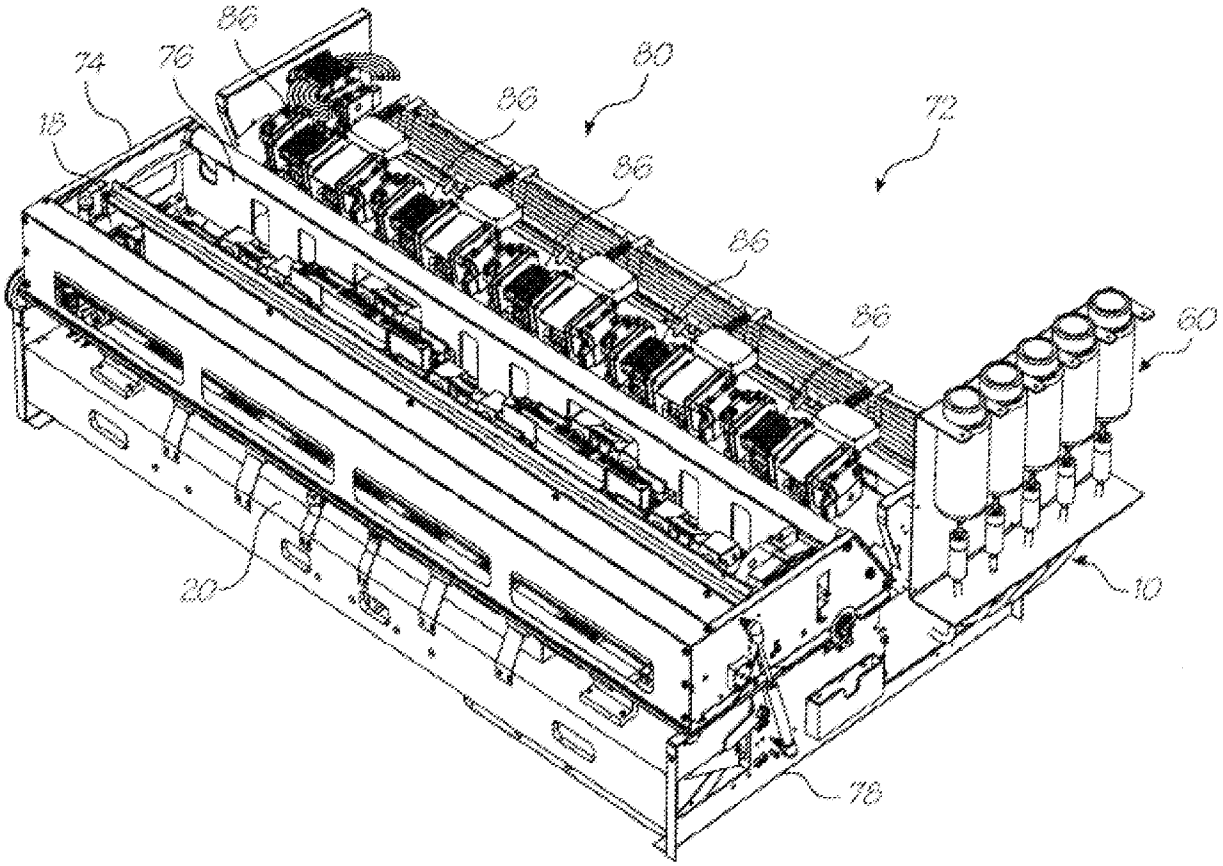
FIG. 4 is a front perspective of a print engine.
Figure 5:
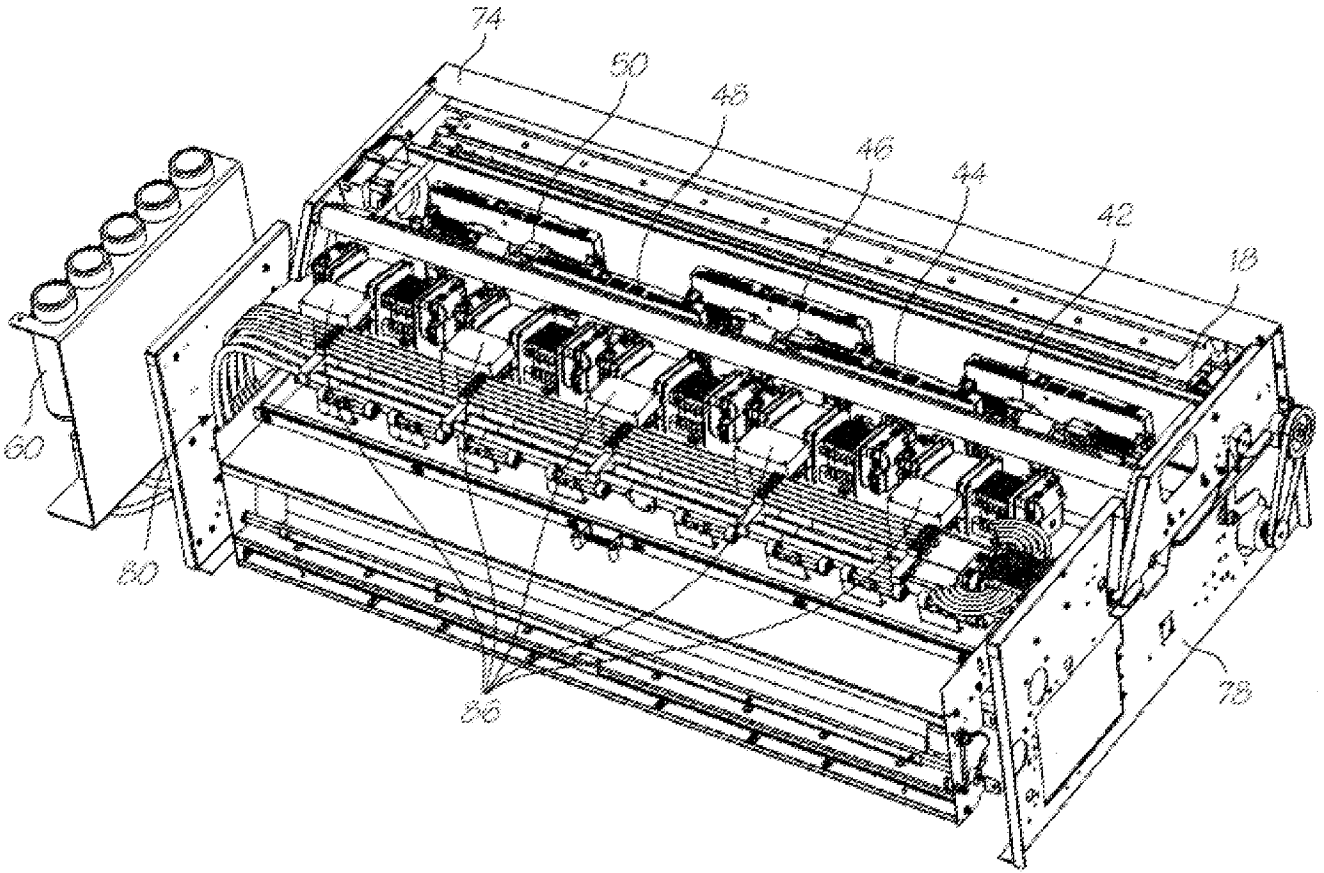
FIG. 5 is a rear perspective of a print engine shown in FIG. 5.
Figure 6:
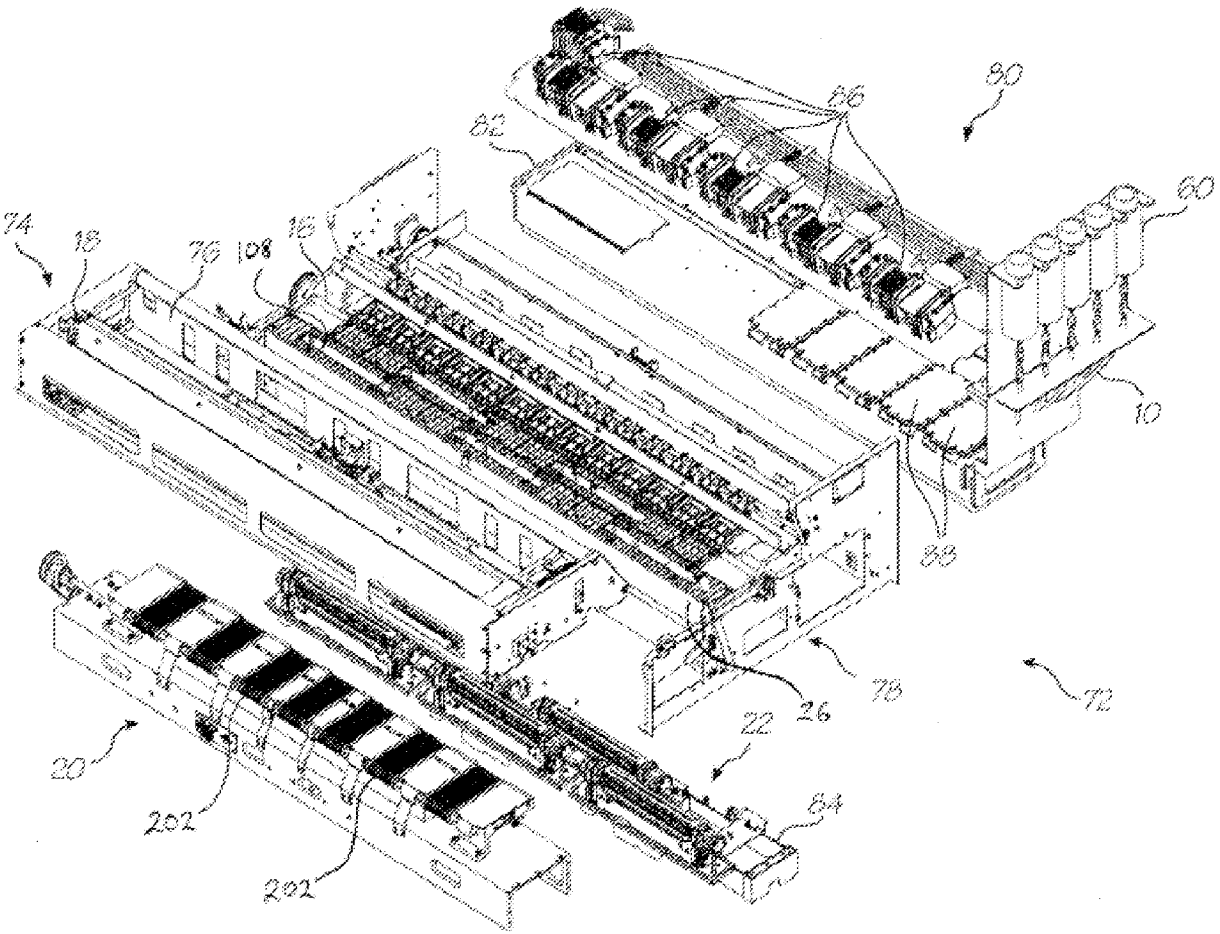
FIG. 6 is an exploded perspective of the print engine shown in FIG. 5.

FIGS. 4 and 5 are perspective views of the wide format print engine 72 in its entirety. FIG. 6 is an exploded rear perspective of the wide format print engine 72. The major components of the print engine 72 are the upper path assembly 74 including the datum printhead carriage 76, the lower paper path assembly 78 including a vacuum belt assembly 200, the ink distribution assembly 80 including ink tanks 60, pinch valves 86 and pressure-regulating accumulator reservoirs 88.

A more detailed explanation of an exemplary ink delivery system, including the ink tanks 60 and accumulator reservoirs 88, can be found in US2011/0025748.

FIG. 6 shows the fixed vacuum platen 26 having service apertures 108, which receive rotatable service modules 22 mounted on service chassis 84. The five service modules 22 embedded in the fixed vacuum platen 26 provide capping and wiping modes for maintaining the printhead modules 42, 44, 46, 48 and 50. Additionally, the five embedded service modules 22 provide a vacuum platen mode, so as to provide a seamless vacuum platen in the print zone 14 during normal printing. Different service modules may be selected to function in different modes depending on the width of the media sheet 54 and the number of printhead modules employed in a particular print job. Again, a more detailed explanation of the function of the service modules 22 can be found in US 2011/0025748.

Figure 7:
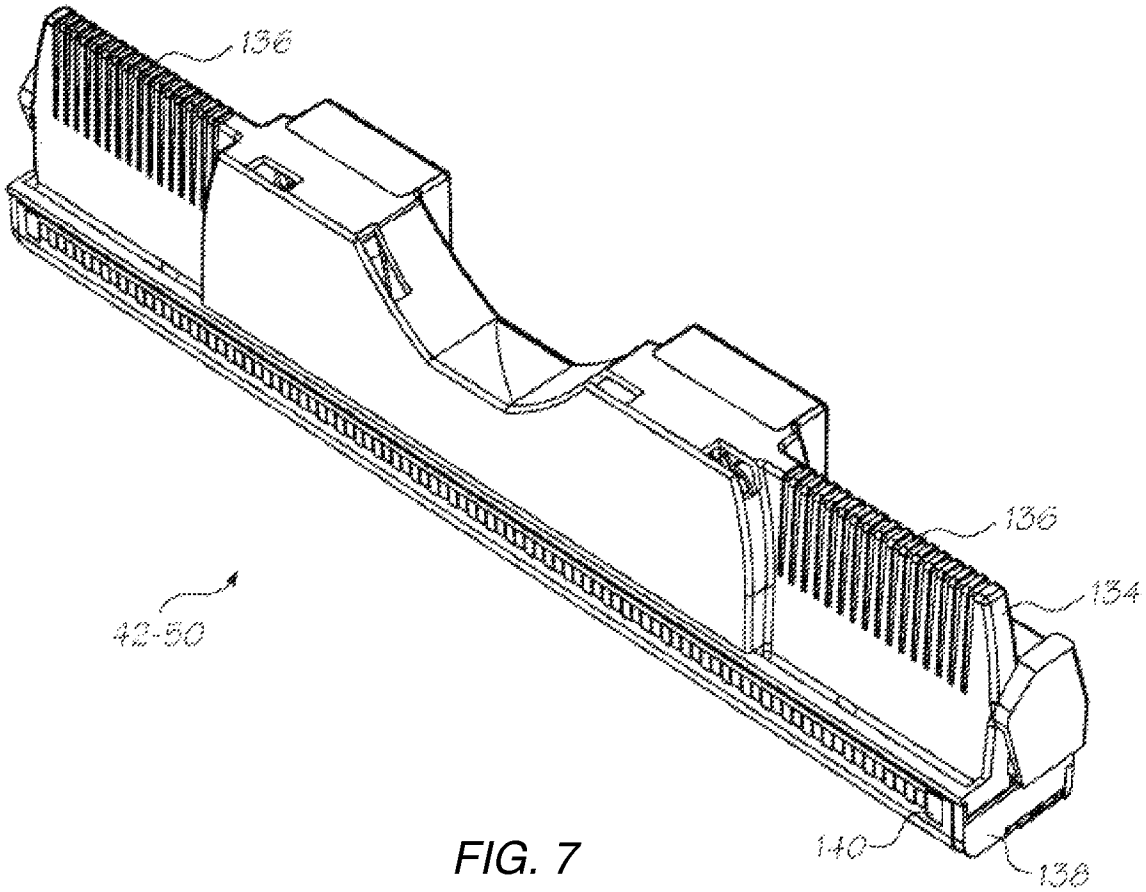
FIG. 7 is a front perspective of a printhead module.
Figure 8:
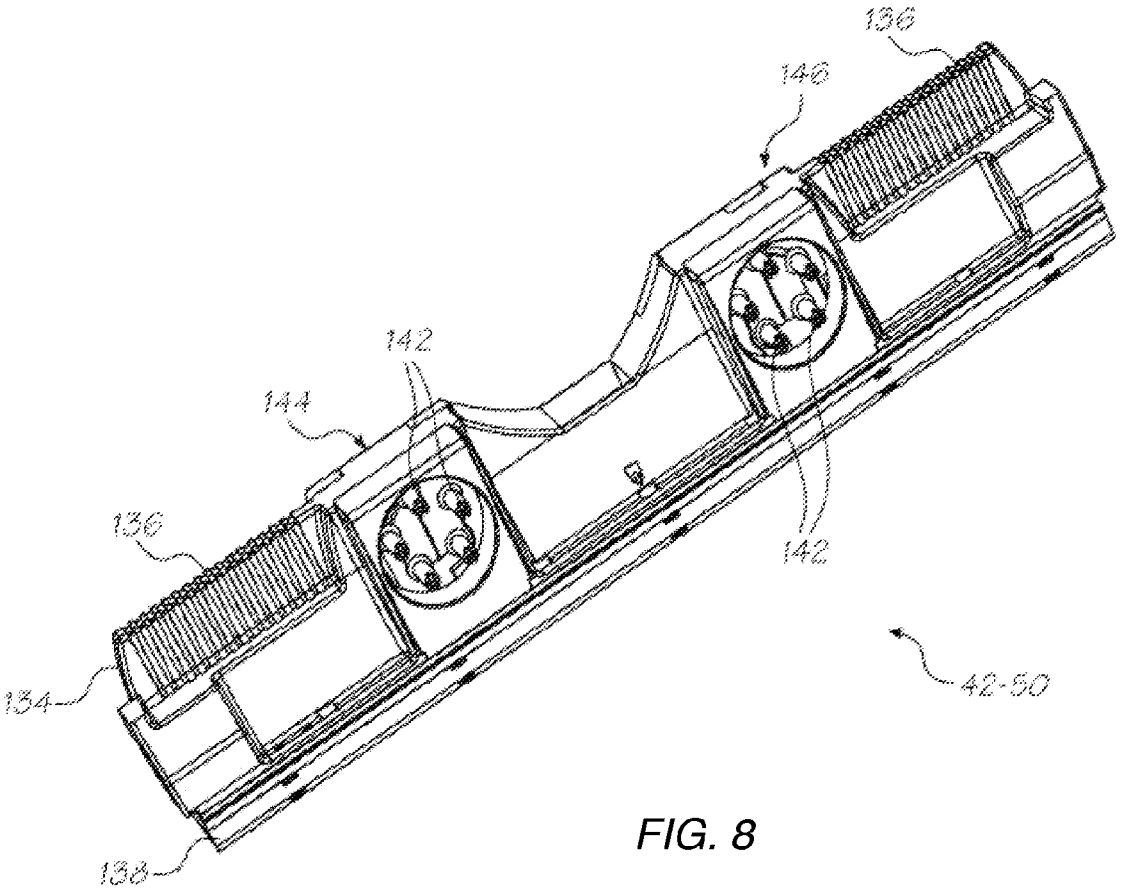
FIG. 8 is a rear perspective of the printhead module shown in FIG. 7.

FIGS. 7 and 8 are perspective views of one the printhead modules 42-50. The printhead modules are each a user-replaceable component of the printer 1 and similar in construction to the printhead cartridge described in US2010/0157001, the contents of which are incorporated herein by reference. Briefly, each of the printhead modules 42-50 has a polymer upper molding 134 mounted on an LCP (liquid crystal polymer) molding 138. A plurality of printhead ICs (not shown in FIGS. 7 and 8) are bonded to the LCP molding 138, which distributes ink to each of the printhead ICs. The upper molding 134 has an inlet socket 144 and an outlet socket 146 in fluid communication with ink feed channels defined in the LCP molding 138.

The ink inlet and outlet sockets (144 and 146) each have five ink spouts 142—one spout for each available ink channel. For example, the printer may have five channels; CMYKK (cyan, magenta, yellow, black and black).

The ink spouts 142 are arranged in a circle for engagement with complementary fluid couplings (not shown) in the print engine 72 during installation of the printhead module. Likewise, a row of electrical contacts 140 are configured for engagement with complementary contacts (not shown) in the print engine 72 during installation of the printhead module. The upper molding 134 also has a grip flange 136 at either end for manipulating the module during installation and removal.

Vacuum Belt Assembly

From the foregoing, and with particular reference to FIGS. 2 and 3, it will be appreciated that the known vacuum belt assembly 20 performs a key function in the printer 1 described herein. As described above, the known vacuum belt assembly 20 comprises a plurality of apertured vacuum belts 202 spaced apart across the media width. Each apertured vacuum belt 202 is tensioned between a pair of pulleys so as to enable continuous rotation of the endless belt. Hence, the vacuum belts 202 serve to move the printed media sheet 54 away from the print zone 14, whilst concomitant vacuum suction acts on the media sheet through apertures in the belts so as to draw the media sheet onto an upper surface of the belts. Moreover, the known vacuum belt assembly 20 cooperates with the drive roller 16 to ensure optimum tension in the media sheet 54 as it is fed through the print zone 14.

In practice, several problems exist with the known vacuum belt assembly 20 described above and described in greater detail in US2011/0025748 (see FIGS. 24 and 25, and paragraphs [0592] to [0595]). Firstly, the 'moving vacuum' provided by the apertured belts 202 does not provide sufficient stability as the print medium traverses over the belts. Secondly, the vacuum arrangement does not provide any fine control of the suction force applied to the print medium as it passes over the belts 202 from an upstream side of the known vacuum belt assembly 20 (proximal to the printheads) to a downstream side (distal from the printheads). Thirdly, any deviation of the vacuum belts 202, and particularly, any relative deviation between each of the seven vacuum belts, is inevitably transferred to the print medium. As foreshadowed above, such deviations tend to cause media buckling zones which propagate upstream into the print zone 14 and, consequently, cause a deterioration in print quality. Moreover, microscopic belt deviations are amplified in the print medium over the duration of printing, such that media buckling is difficult to eliminate even with improved manufacturing tolerances in the known vacuum belt assembly 20.

In view of some of the problems associated with the known vacuum belt assembly 20 described in FIGS. 2 and 3, the present inventors have devised a modified vacuum belt assembly 200 shown in FIGS. 4, 6 and 9 to 20 and described in detail hereinbelow. The vacuum belt assembly 200 may be incorporated into the printer 1 described above in place of the known vacuum belt assembly 20, with all other components performing essentially the same function as described above.

Figure 9:
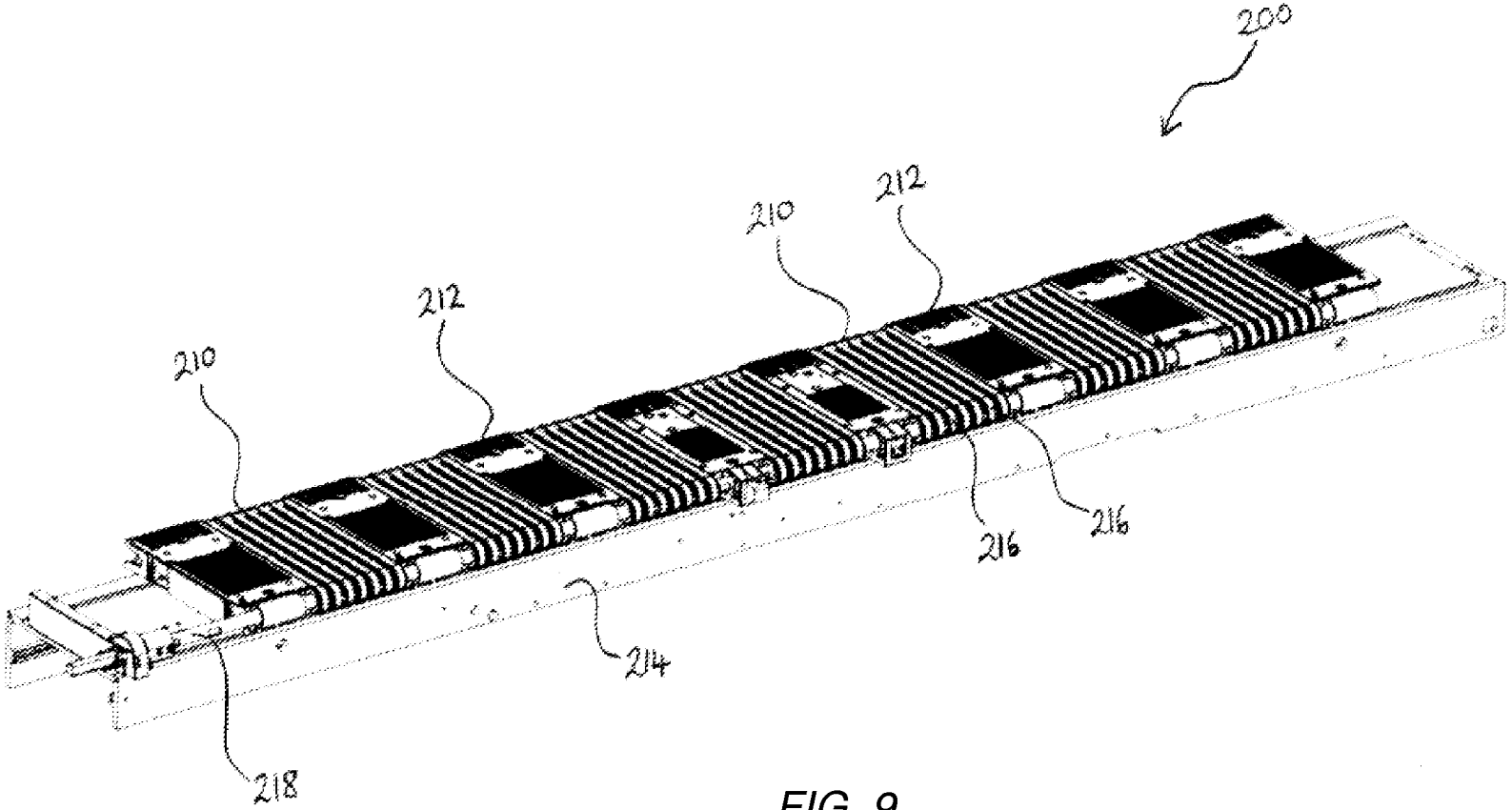
FIG. 9 is a rear perspective of a vacuum belt assembly according to the present invention.

Referring initially to FIG. 9, the vacuum belt assembly 200 is a modular assembly comprised of a plurality of moving belt modules 210 and a plurality of static platen modules 212 mounted on a support chassis 214. The vacuum belt assembly 200 is substantially coextensive with a width of the media path. The moving belts modules 210 and static platen modules 212 are mounted in an alternating arrangement, such that a static platen module is positioned between each adjacent pair of moving belt modules.

Figure 13:
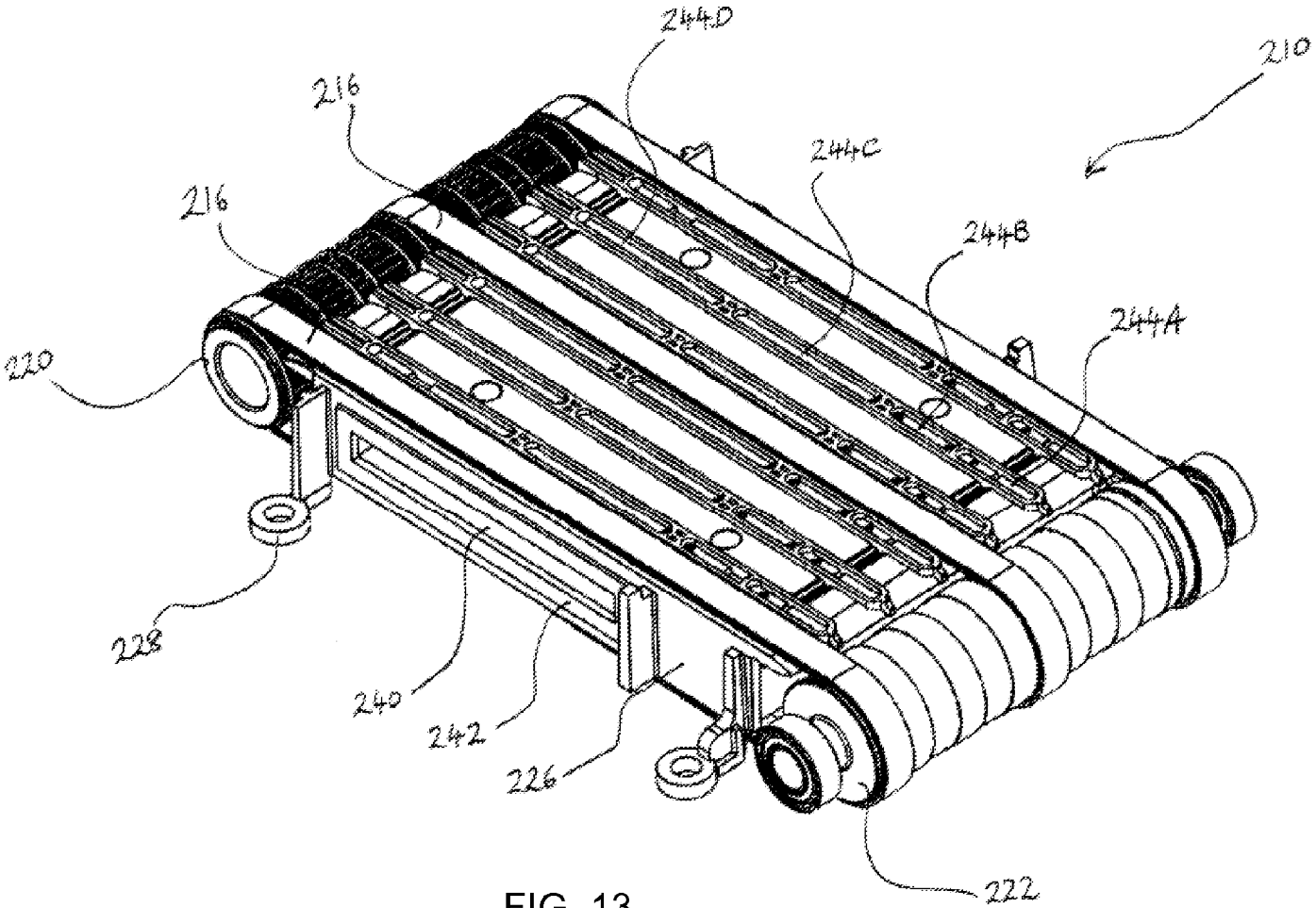
FIG. 13 is a front perspective of a moving belt module.

Each moving belt module 210 comprises a set of spaced apart belts 216 tensioned between a drive pulley 220 and an idler pulley 222 (see FIG. 13). As shown in FIG. 9, each moving belt module 210 comprises a set of seven spaced apart belts 216. However, it will be appreciated that each moving belt module 210 may comprise a set of belts having a greater or smaller number of belts 216. Typically, each set of belts 216 comprises at least three spaced apart belts.

A drive shaft 218 is rotatably mounted on the support chassis 214 for rotating each of the drive pulleys 220 and, hence, each of the belts 216 synchronously. The drive shaft 218 extends along the extent of the vacuum belt assembly 200. As shown most clearly in FIG. 10, each drive pulley 220 is fixedly mounted on the drive shaft 218, while each static platen module 212 comprises a bearing 224 through which the draft shaft is received and in which the drive shaft rotates freely. A drive motor (not shown) under the control of the supervising PCB is operatively connected to the drive shaft 218.

The drive shaft 218 and drive pulleys 220 are positioned at a downstream side of the vacuum belt assembly 200, while the idler pulleys are positioned at an upstream side of the vacuum belt assembly. Hence, as viewed in FIGS. 9 and 10, the media feed direction is generally towards the viewer; and as viewed in FIG. 11, the media feed direction is generally away from the viewer.

Figure 12:
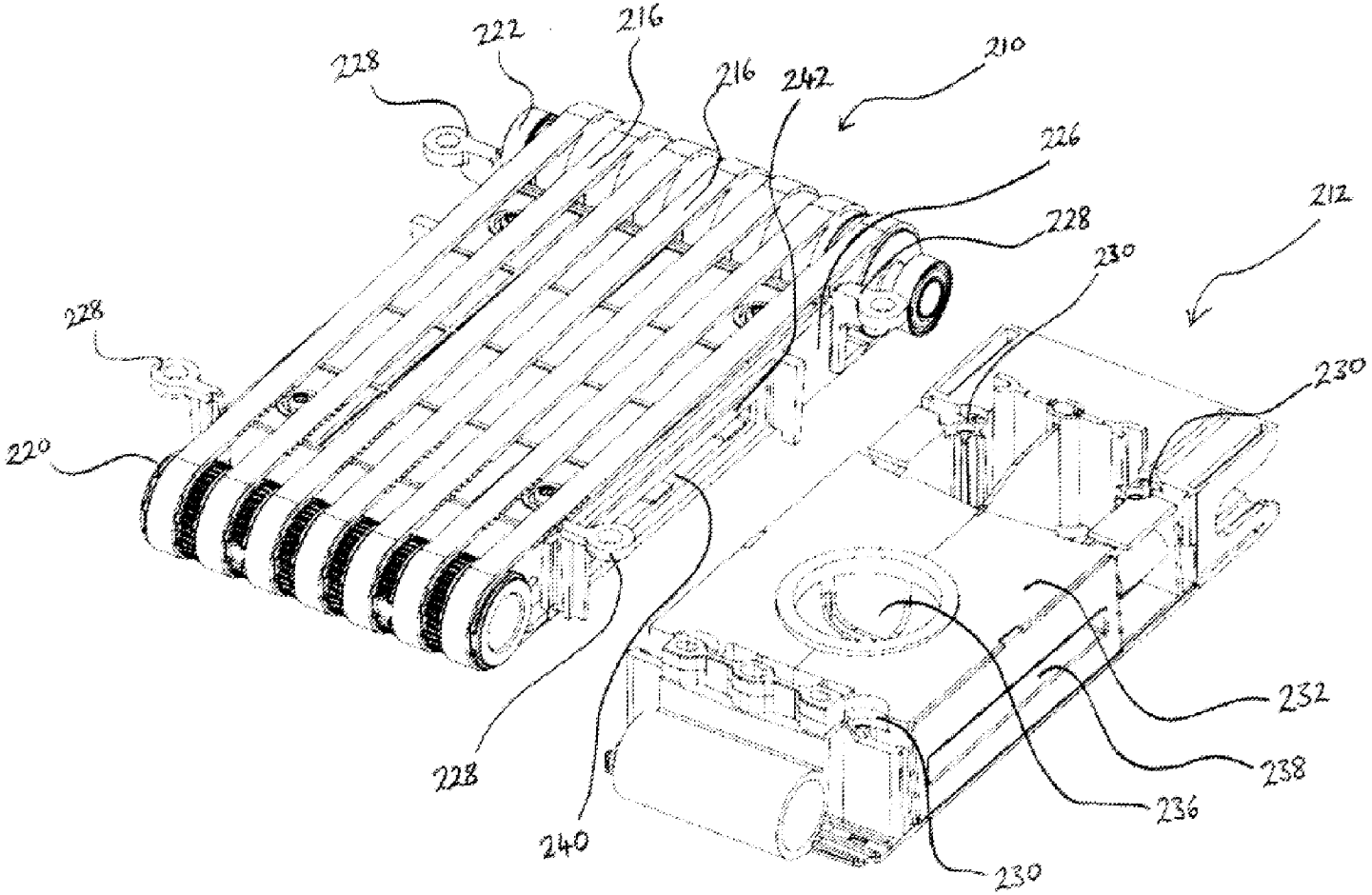
FIG. 12 is an exploded rear perspective of a moving belt and static platen module pairing viewed from an underside.

Referring to FIG. 12, there is a shown an exploded perspective of a moving belt and static platen module pairing viewed from an underside. The moving belt module 210 comprises a first body 226 having a plurality of laterally extending lugs 228 (one pair of lugs 228 on either side of the body 226), which engage and interlock with complementary datum features 229 in the form of recesses defined in a second body 232 of the neighboring static platen module 212. The lugs 228 are fixed into position with locking screws 230. The lugs 228 and complementary datum features 229 assist in alignment of the moving belt and static platen modules along the extent of the modular vacuum belt assembly 200.

Still referring to FIG. 12, the first and second bodies 226 and 232 of the moving belt and static platen modules 210 and 212 each define a respective internal chamber. The lower surface of the static platen module 212 comprises a vacuum port 236, which communicates with the internal chamber of the second body 232. In use, the vacuum port 236 is connected to a vacuum source (not shown) such as a vacuum blower or vacuum pump. The second body 232 of the static platen module 212 has a sidewall opening 238, which meets with a complementary sidewall opening 240 defined in the first body 226 of a neighboring moving belt module 210. Accordingly, the internal chambers of the moving belt and static platen modules 210 and 212 are interconnected via respective sidewall openings 240 and 238 to define an elongate vacuum chamber extending across the entire vacuum belt assembly 200. This elongate vacuum chamber defines a common vacuum chamber for the whole vacuum belt assembly 200. Perimeter gaskets 242 (only one shown in FIG. 12) around the sidewall openings 240 of each moving belt module 210 are provided to maintain a vacuum seal between neighboring modules.

Figure 14:
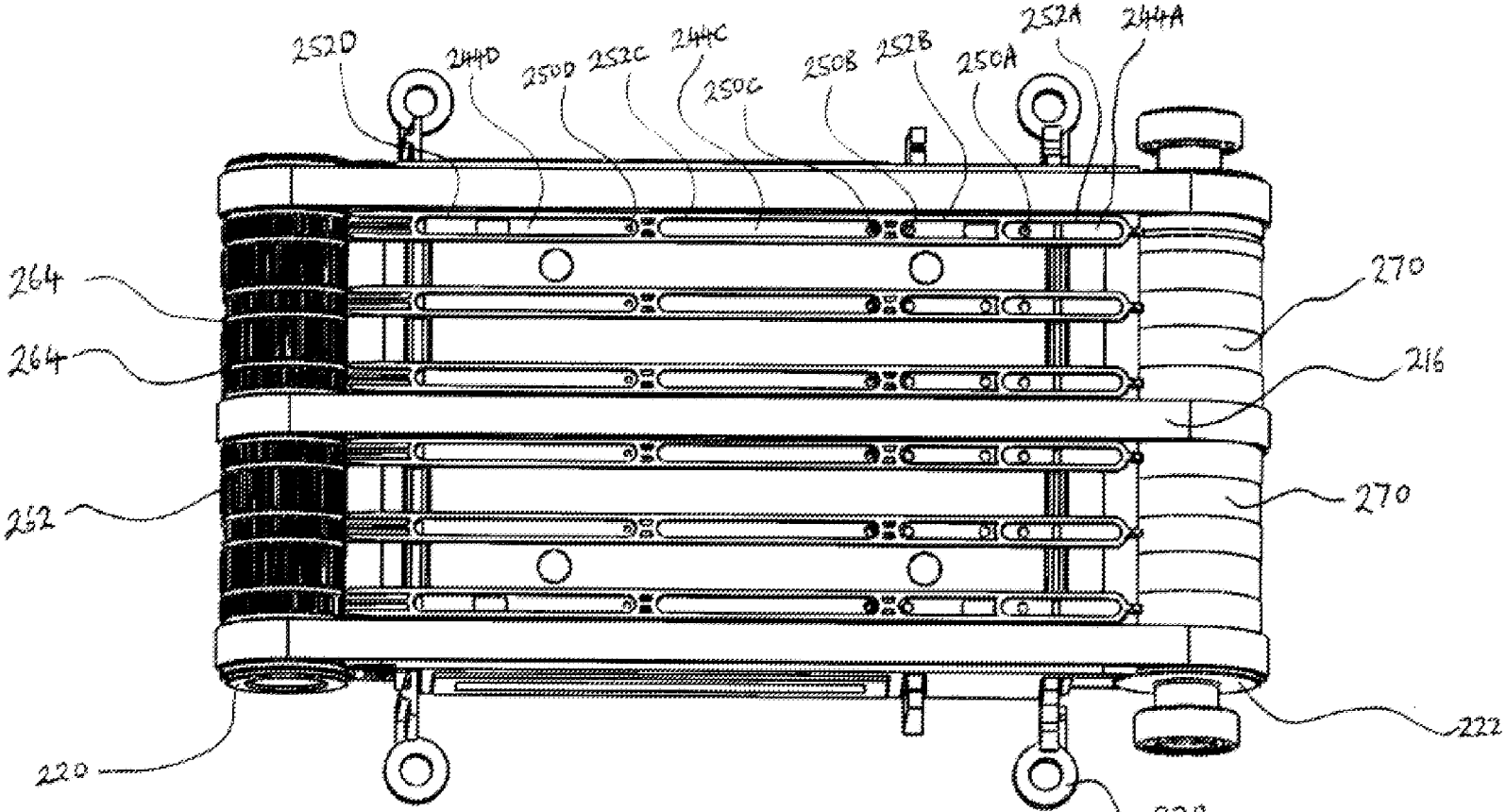
FIG. 14 is a top plan view of the moving belt module shown in FIG. 13.

Referring now to FIGS. 13 and 14, there is shown one of the moving belt modules 210 in isolation. For the sake of clarity, only three belts 216 are shown in FIGS. 13 and 14, with four of the seven belts removed. The moving belt module 210 comprises a set of moving belts 216 tensioned between the drive pulley 220 and the idler pulley 222 positioned at opposite ends of the first body 226. The drive pulley 220 and idler pulley 222 are rotatably mounted with their longitudinal axes perpendicular to the media feed direction, such that the belts 216 move in a direction substantially parallel with the media feed direction. Spring loaded belt tensioners (not shown) act on the idler pulley 222 to control tension in the belts 216.

Each belt 216 is a non-apertured belt having a relatively narrow width compared to both the length of the pulleys on which they are mounted and the media width. For example, the ratio of the drive pulley length to the belt width may be at least 4:1, at least 8:1 or at least 20:1. Moreover, the ratio of the media width to the belt width may be at least 100:1, at least 150:1 or at least 200:1. The vacuum belt assembly 200 may comprise at least 20, at least 30 or at least 40 individual belts.

Figure 10:
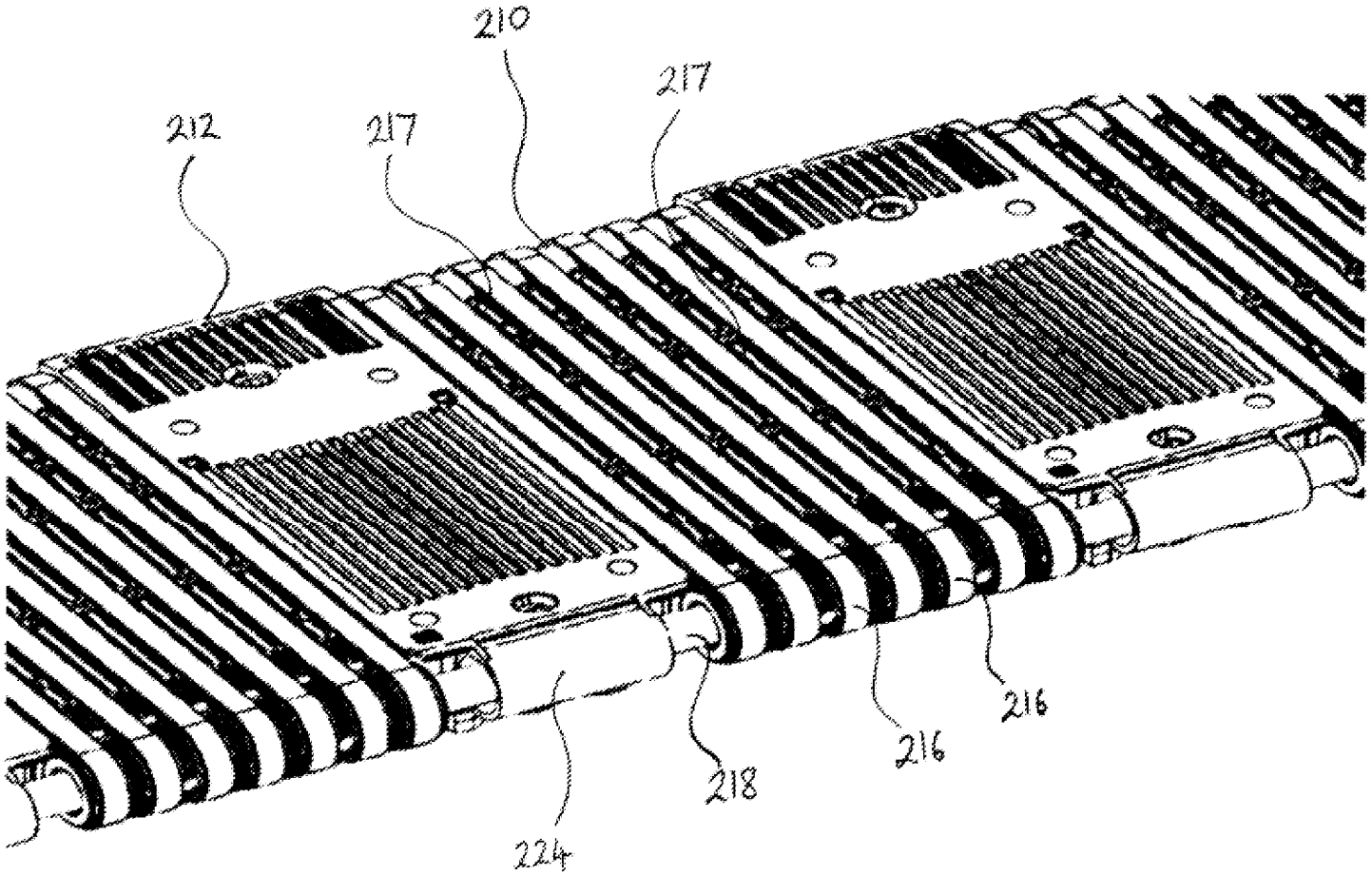
FIG. 10 is a magnified rear perspective of the vacuum belt assembly shown in FIG. 9.
Figure 11:
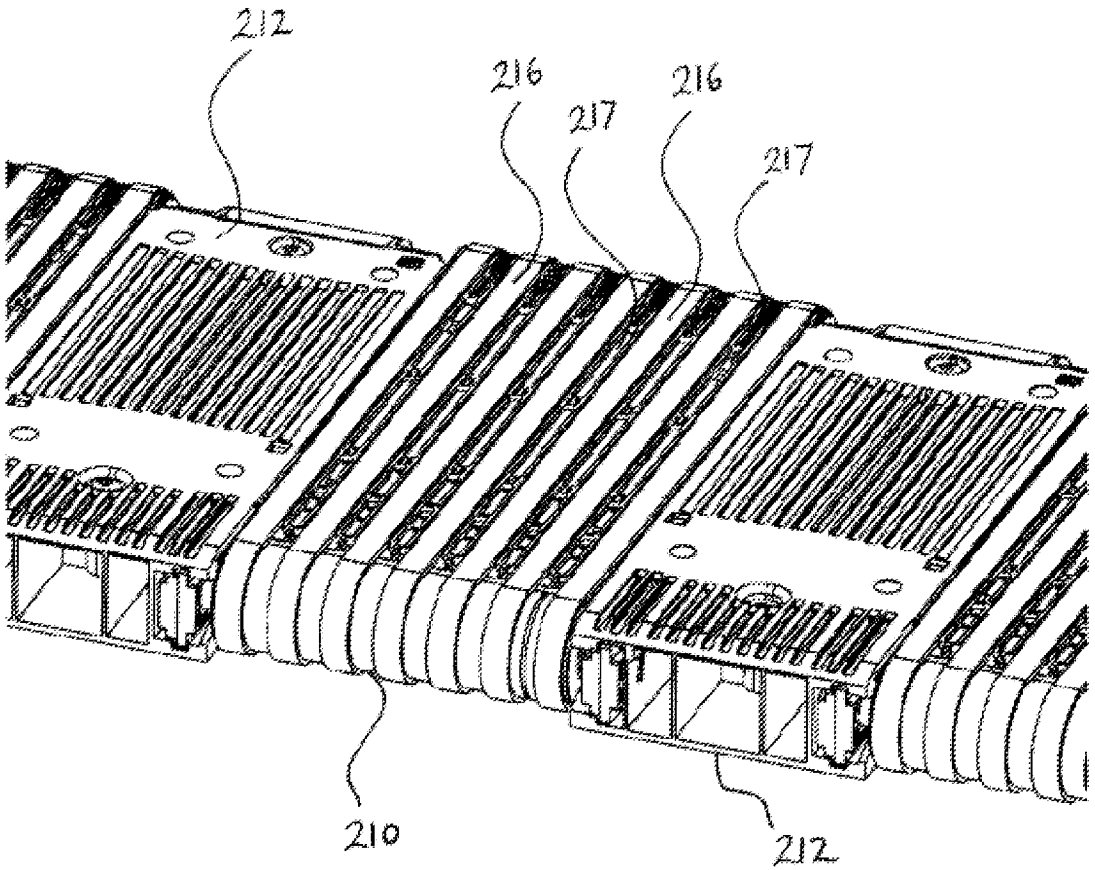
FIG. 11 is a magnified front perspective of the vacuum belt assembly shown in FIG. 9.

Referring briefly to FIGS. 10 and 11, an interstitial gap 217 is defined between each of the spaced apart belts 216 mounted on a common drive pulley 220 in a respective moving belt module 210. Each of these interstitial gaps 217 is in fluid communication with the vacuum chamber of the vacuum belt assembly 200, which is partially defined by the internal chamber of the moving belt module 210. Hence, a print medium moving over the vacuum belt assembly 200 experiences a suction force via the interstitial gaps 217 defined between the non-apertured belts 216, rather than via apertures defined in the belts themselves. By avoiding a 'moving vacuum' arrangement, the print medium has improved stability as it traverses over the vacuum belt assembly 200.

More particularly, and returning now to FIGS. 13 and 14, a series of vacuum antechambers 244A, 244B, 244C and 244D (collectively vacuum antechambers 244) are disposed in each interstitial gap 217 defined between the belts 216 of the moving belt module 210. The vacuum antechambers 244A, 244B, 244C and 244D are in fluid communication with the vacuum chamber via respective vacuum apertures 250A, 250B, 250C and 250D (collectively vacuum apertures 250) defined in a base of each vacuum antechamber. Each of the vacuum antechambers 244A, 244B, 244C and 244D has a respective perimeter opening 252A, 252B, 252C and 252D (collectively perimeter openings 252), which is substantially flush with an upper surface of the belts 216. Hence, the perimeter openings 252 of the vacuum antechambers 244 provide suction engagement with a lower (non-printed) surface of print media traversing over the vacuum belt assembly 200.

The vacuum antechambers 244 (and respective perimeter openings 252) are generally elongate and have a length dimension which extends longitudinally in the media feed direction. Typically, each vacuum antechamber 244 (and respective perimeter opening 252) has a width which is substantially the same or less than the width of the interstitial gap 217 in which the vacuum antechamber 244 is disposed.

As shown most clearly in FIG. 14, the vacuum antechamber 244A positioned towards an upstream side of the vacuum belt assembly 200 (i.e. nearest to the printhead assembly 56 and the idler pulley 222) has a perimeter opening 252A which is shorter in length than the vacuum antechamber 244D positioned towards a downstream side of the vacuum belt assembly (i.e. furthest from the printhead assembly 56 and nearest to the drive pulley 220).

The relative lengths of the vacuum antechambers 244 (and corresponding perimeter openings 252) is an important feature of the vacuum belt assembly 200. At the upstream side of the vacuum belt assembly 200, a leading edge portion of the print medium must be grabbed quickly and pulled taught onto the belts 216 by the suction force. By having a relatively short vacuum antechamber 244A at the upstream side, a "vacuum cup" is quickly established with the leading edge portion of the print medium, which minimizes any initial lateral movement of the print medium relative to the belts. If the vacuum antechamber 244A were to have a longer perimeter opening, then the vacuum seal would take longer to establish and provide more opportunity for lateral movement of the print medium as it enters the vacuum belt assembly 200. (For the avoidance of doubt, the right-hand side of the moving belt module 210 shown in FIG. 14 is "upstream", while the left-hand side is "downstream"; the print medium moves right to left as shown in FIG. 14).

Commensurate with the relative lengths (and chamber volumes) of the vacuum antechambers 244, the vacuum apertures 250 also vary in size so as to provide greater suction force at the upstream side of the vacuum belt assembly 200 compared to the downstream side. Accordingly, the vacuum aperture 250A defined in the upstream vacuum antechamber 244A has a larger diameter than the vacuum aperture 250D defined in the downstream antechamber 244D. The relatively larger diameter of vacuum aperture 250A combined with the relatively smaller volume of vacuum antechamber 244A means that the upstream side of the vacuum belt assembly 200 develops a stronger suction force than the downstream side. A relatively weaker vacuum force towards the downstream side of the vacuum belt assembly, by virtue of the relatively smaller diameter vacuum apertures 250C and 250D and relatively larger volume vacuum antechambers 244C and 244D, is optimal for minimizing media buckling as will be explained in more detail below.

Figure 15:
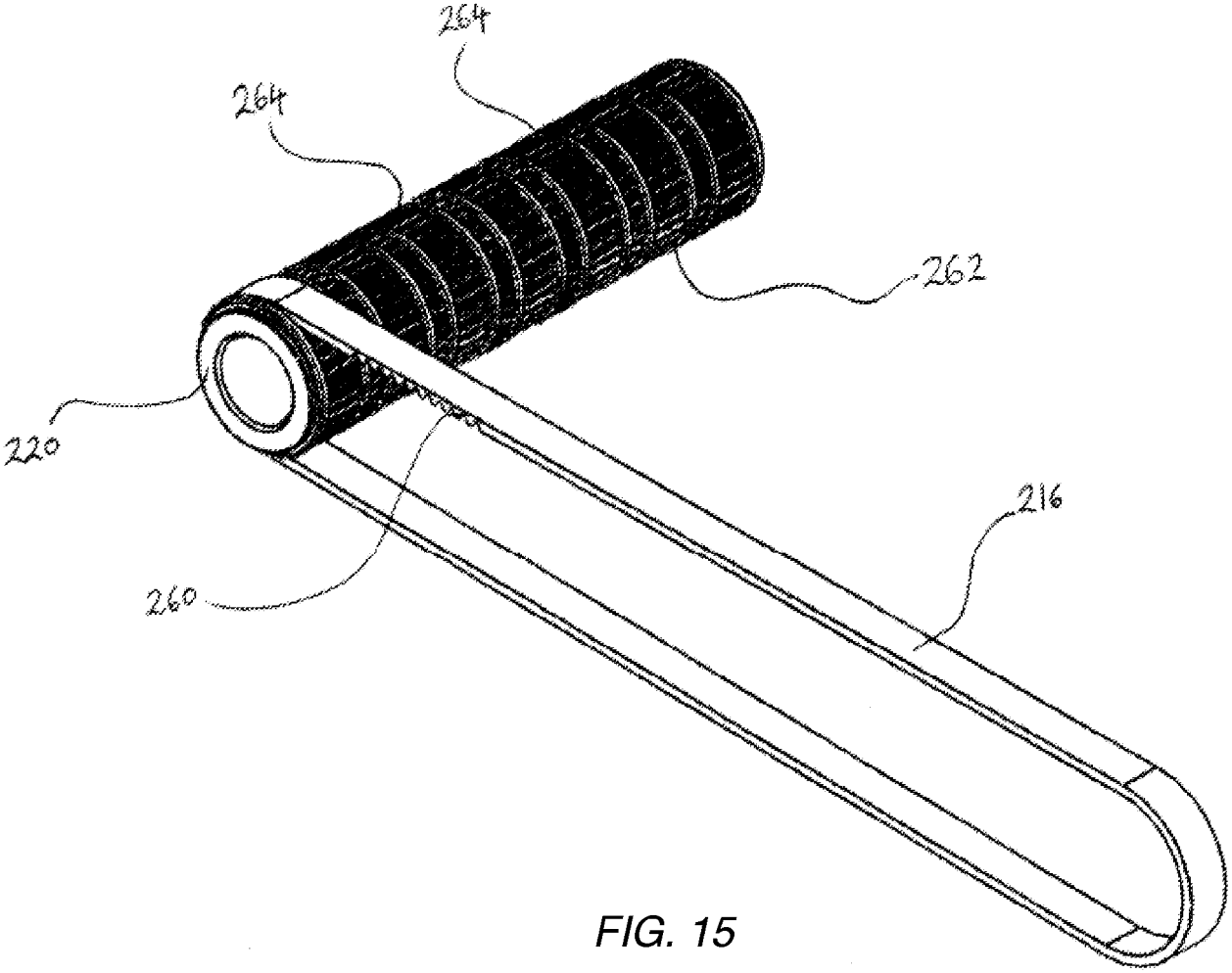
FIG. 15 is a perspective of an individual belt seated between circumferential ribs of a drive pulley.

Referring now to FIG. 15, each of the endless belts 216 has a toothed inner surface 260 for intermeshing engagement with longitudinally extending grooves 262 defined in an outer surface of the drive pulley 220. The belt 216 may be toothed along only a section thereof, or toothed around its entire inner surface. Hence, each belt 216 functions as a timing belt in cooperation with the drive pulley 220.

A series of circumferential ribs 264 extend radially outwardly from the drive pulley 220 and are spaced apart along the longitudinal axis of the drive pulley to provide two important functional aspects of the vacuum belt assembly 200. The ribs 264 are positioned, firstly, to maintain a predetermined interstitial spacing between the belts 216 mounted about the drive pulley 220. As shown in FIG. 15, each pair of ribs having a relatively narrow spacing therebetween defines the interstitial spacing between adjacent belts 216 in the moving belt module 210. Secondly, the ribs 264 are positioned to allow a degree of constrained lateral movement of the belts 216 along the longitudinal axis of the drive pulley 220. In particular, each belt 216 is seated between a pair of relatively widely spaced ribs 264, which allow a degree of constrained lateral belt movement. In other words, the spacing between these pairs of ribs is wider than the width of the belts 216. The extent of allowed lateral belt movement, as determined by the rib spacing, is relatively small. Typically, the distance between the pair of ribs 264 constraining belt movement is less than 2 mm greater than the belt width, or less than 1 mm greater than the belt width. Typically, the maximum belt angle allowed by the rib spacing is less than 1 degree, less than 0.5 degrees or less than 0.25 degrees, where the belt angle is defined as the angle relative to a line perpendicular to the longitudinal axis of the drive pulley 220.

At the upstream side of the vacuum belt assembly 200, and referring now to FIGS. 13 and 14, the idler pulley 222 has a series of circumferential recesses 270 in which the belts 216 are seated. The width of the circumferential recesses 270 corresponds to the width of the belts 216, such that no lateral movement of the belts is allowed along the longitudinal axis of the idler pulley 222. The circumferential recesses 270 have a smooth surface and the inner surface of the belt 216 frictionally engages with this recessed surface (in contrast with the intermeshing engagement between the belt 216 and the drive pulley 220).

By allowing each individual belt 216 to move laterally and independently along the longitudinal axis of the downstream drive pulley 220, the steering of each set of belts becomes self-correcting over the duration of printing. In this way, media buckling is minimized. Moreover, the decreased vacuum force towards the downstream side of the vacuum belt assembly 200, by virtue of the relative volumes of the vacuum antechambers 244 and vacuum apertures 250 as described above, encourages a degree of lateral movement of the belts 216 along the drive pulley axis and helps to maintain the self-correcting characteristics of belt steering.

Figure 16:
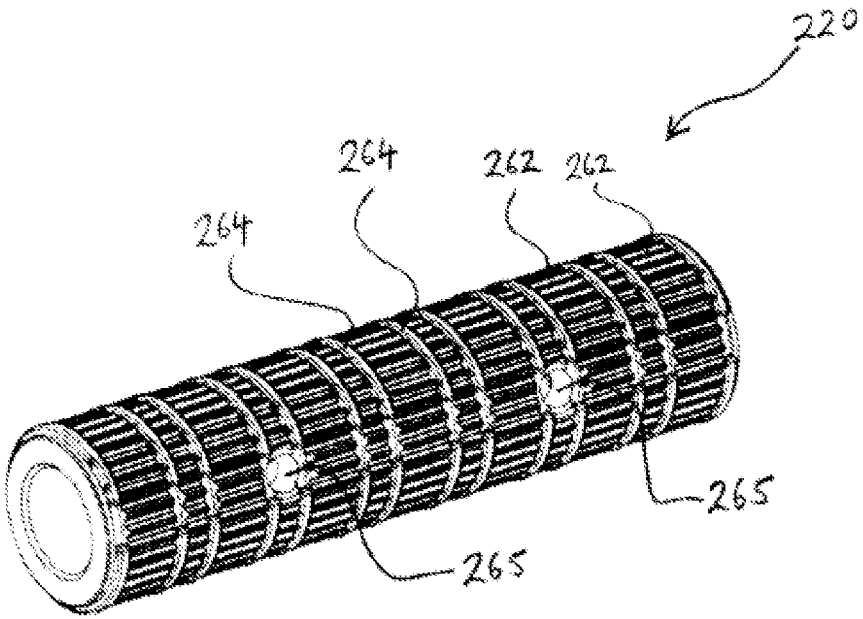
FIG. 16 is a perspective of a drive pulley.
Figure 17:
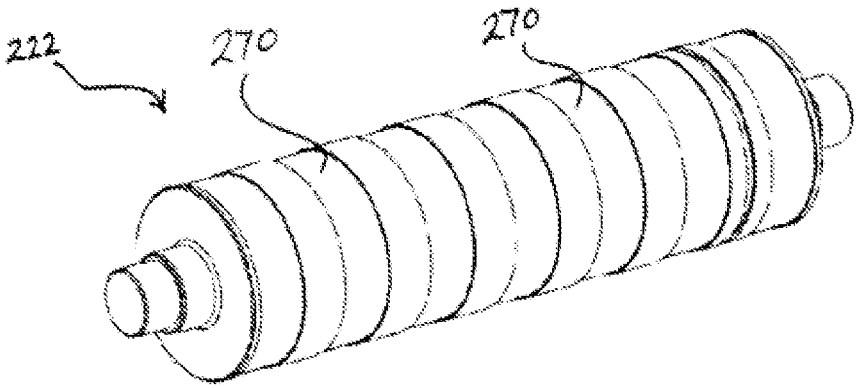
FIG. 17 is a perspective of an idler pulley.

FIGS. 16 and 17 are perspective views of the drive pulley 220 and idler pulley 222 in isolation. In particular, FIG. 16 shows more clearly the longitudinally extending grooves 262 and circumferential ribs 264 of the drive pulley 220 described above. Screw openings 265 are defined for fixedly mounting the drive pulley 220 on the drive shaft 218 for rotation therewith.

Figure 18:
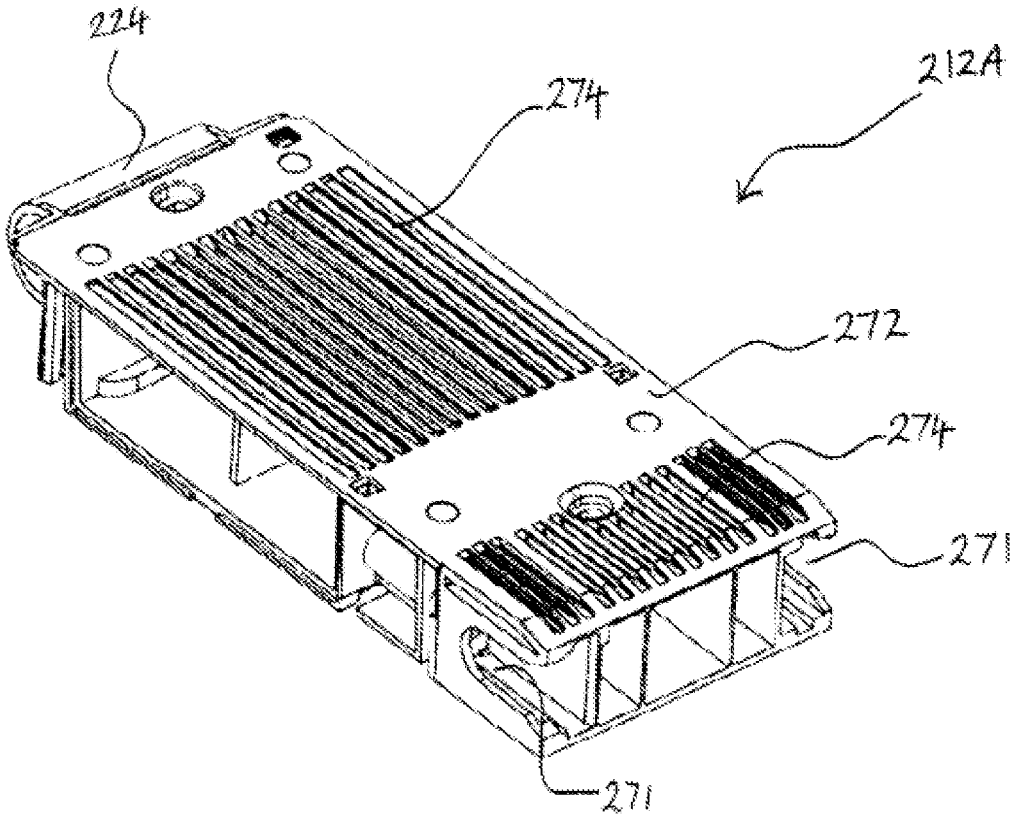
FIG. 18 is a front perspective of a first static platen module.
Figure 19:
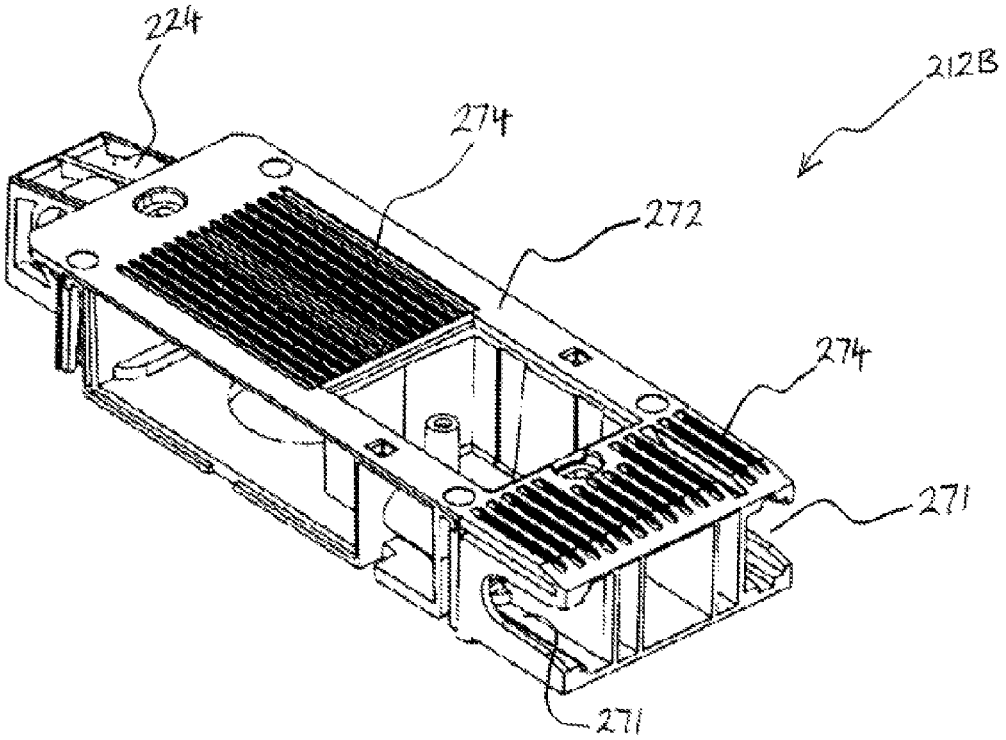
FIG. 19 is a front perspective a second static platen module.

Turning now to FIGS. 18 and 19, there is shown a first static platen module 212A and a second static platen module 212B (collectively referred to as static platen modules 212) in isolation. The first and second static platen modules 212A and 212B have the common features of the bearing 224 at the downstream end and mounting slots 271 at the opposite upstream end.

As described above in connection with FIG. 9, the bearing 224 at the downstream end of each static plate module 212 receives the drive shaft 218, thereby enabling the drive shaft to rotate each of the drive pulleys 200 and, hence, each of the belts 216 in unison.

At the opposite upstream end of the static platen module 212, each mounting slot 271 defines a mounting for one end of an idler pulley 222 from a neighboring moving belt module 210. The engagement between the idler pulley 222 of a moving belt module 210 and the mounting slot 271 of a neighboring static platen module 212 is shown in FIGS. 11 and 12. The idler pulley 222 is biased against the mounting slot 271 of the static platen module 212 via a compression spring (not shown).

In addition, the first and second static platen modules 212A and 212B have the common feature of an upper platen surface 272 having a plurality of grooves 274 defined therein. The upper platen surface 272 supports print media between the moving belt modules 210, while the grooves 274 extending longitudinally in the media feed direction minimize frictional engagement between the print media and the upper platen surface 272. The grooves 274 are merely for reducing friction and are not apertured through to the internal chamber of the static platen module. In other words, the static platen modules 212 do not exert any suction on the print media via the upper platen surface 272. All the vacuum force experienced by the print media is finely controlled via the vacuum antechambers 244 described above.

Figure 20:
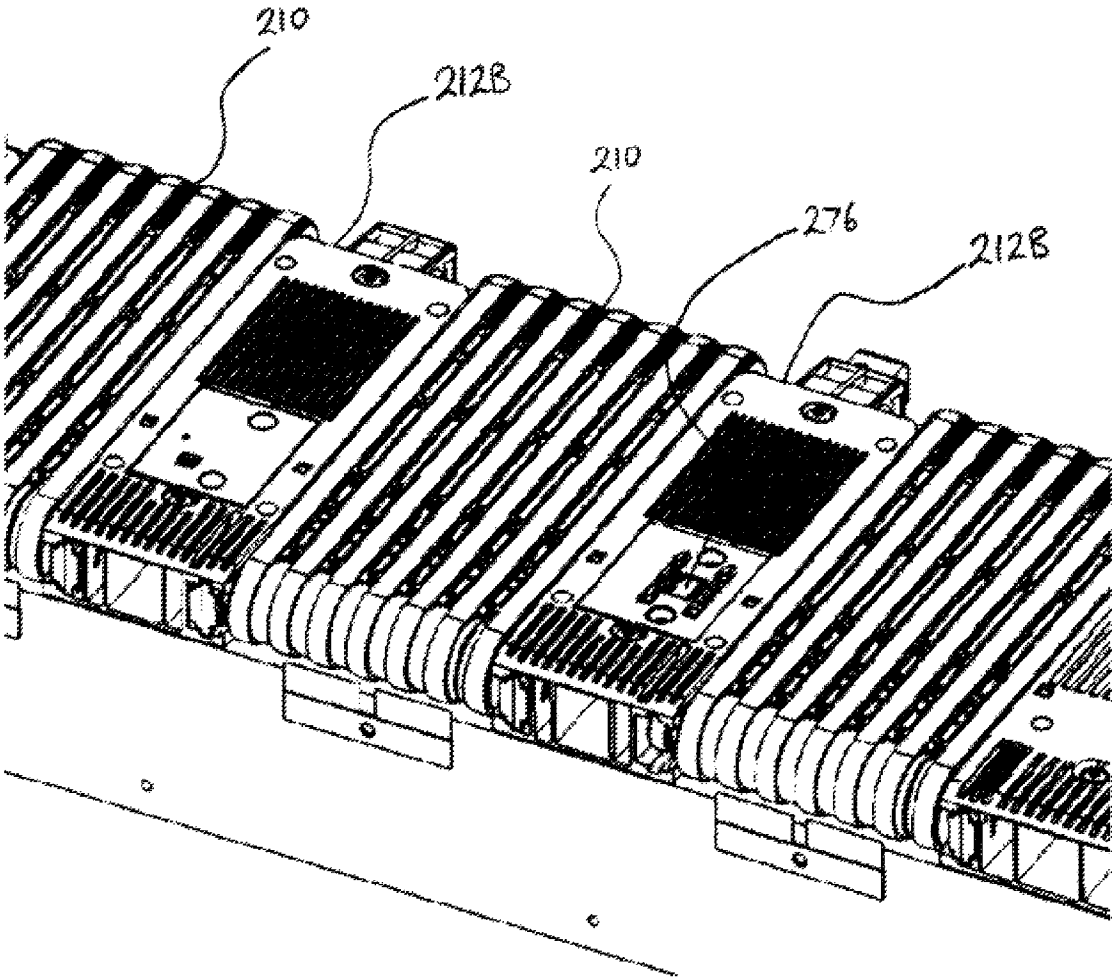
FIG. 20 is a magnified front perspective of the vacuum assembly shown in FIG. 1 with incorporating the first static platen module of FIG. 18.

Referring to FIGS. 19 and 20, one of the second static platen modules 212B accommodates an encoder wheel 276, which is embedded in an opening defined in the upper platen surface 272. The encoder wheel 276 accurately monitors the speed of print media traversing over the vacuum belt assembly 200 and provides feedback to the print engine controller. By embedding the encoder wheel 276 in one of the static platen modules 212, the accuracy of print media speed information is improved. This information may be used to control the timing of nozzle firing pulses from the printheads 42-50 after the trailing edge of the media sheet 54 has disengaged from the drive roller 16.

It will, of course, be appreciated that the present invention has been described by way of example only and that modifications of detail may be made within the scope of the invention, which is defined in the accompanying claims.

The invention claimed is:

1. A printer comprising a vacuum belt assembly for moving print media in a media feed direction along a media path, the vacuum belt assembly comprising:

a plurality of spaced apart endless belts tensioned between first and second pulleys;

a vacuum chamber for drawing print media onto an upper surface of the belts; and a plurality of vacuum antechambers communicating with the vacuum chamber, each vacuum antechamber having a perimeter opening for suction engagement with print media, wherein the vacuum antechambers are together configured to provide greater suction at an upstream side of the belts relative to a downstream side of the belts, the upstream and downstream sides being defined relative to the media feed direction.

2. The printer of claim 1, wherein the vacuum antechambers are positioned in an interstitial gap defined between each adjacent pair of belts.

3. The printer of claim 2, wherein each perimeter opening has a width which is narrower than the interstitial gap between adjacent belts.

4. The printer of claim 2, wherein the belts are non-apertured.

5. The printer of claim 1, wherein the second pulley is a drive pulley positioned downstream of the first pulley.

6. The printer of claim 1, wherein each belt is toothed and intermeshes with complementary grooves in the second pulley.

7. The printer of claim 1, wherein the vacuum chamber is a common vacuum chamber communicating with each vacuum antechamber in the vacuum belt assembly, the common vacuum chamber being connected to a vacuum source in the printer.

8. The printer of claim 1, wherein the vacuum belt assembly is a modular assembly comprised of a plurality of moving belt modules and a plurality of static platen modules.

9. The printer of claim 8, wherein the moving belt modules and static platen modules are interconnected in an alternating arrangement to define the vacuum belt assembly.

10. The printer of claim 9, wherein the vacuum chamber extends through a body of each of the interconnected moving belt modules and static platen modules.

11. The printer of claim 1, wherein each moving belt module comprises a respective set of said spaced apart endless belts, each set of said belts being tensioned between one first pulley and one second pulley.

12. The printer of claim 11, wherein the second pulley comprises a plurality of circumferential ribs, each belt in the set being mounted between a respective pair of ribs.

13. The printer of claim 12, wherein a spacing between the pair of ribs is greater than a width of the belt so as to allow independent lateral sliding movement of each belt along an axis of the second pulley.

14. The printer of claim 1, further comprising a fixed printhead assembly defining a print zone.

15. The printer of claim 14, wherein the vacuum belt assembly is positioned downstream of the print zone.

16. The printer of claim 15, further comprising a drive roller positioned upstream of the print zone and a fixed vacuum platen positioned in the print zone.

17. The printer of claim 1, which is a wideformat printer.

* * * * *